US012024330B1

(12) United States Patent
Sheridan

(10) Patent No.: US 12,024,330 B1
(45) Date of Patent: Jul. 2, 2024

(54) DEVICE AND METHOD FOR STUFFING THROW BAGS AND LIFE SAFETY BAGS

(71) Applicant: Jake Cody Sheridan, Coweta, OK (US)

(72) Inventor: Jake Cody Sheridan, Coweta, OK (US)

(73) Assignee: ROPE BAG SOLUTIONS LLC, Coweta, OK (US)

( * ) Notice: Subject to any disclaimer, the term of this patent is extended or adjusted under 35 U.S.C. 154(b) by 0 days.

(21) Appl. No.: 17/968,525

(22) Filed: Oct. 18, 2022

(51) Int. Cl.
*B65B 67/04* (2006.01)

(52) U.S. Cl.
CPC ..... *B65B 67/04* (2013.01)

(58) Field of Classification Search
CPC ..... B65B 67/04; B65H 54/76
USPC ..... 53/473, 325
See application file for complete search history.

(56) References Cited

U.S. PATENT DOCUMENTS

| | | | | |
|---|---|---|---|---|
| 1,541,683 | A | 6/1925 | Buehler | |
| 2,386,371 | A * | 10/1945 | Vose | B65H 54/76 270/30.01 |
| 3,014,262 | A * | 12/1961 | Morgan | B65H 54/76 57/76 |
| 6,629,867 | B1 | 10/2003 | Smith | |
| 6,679,743 | B1 | 1/2004 | Gerber | |
| 8,882,016 | B1 * | 11/2014 | Melvin | B65H 75/4492 242/405 |
| 9,434,458 | B2 * | 9/2016 | Macri | B63C 9/26 |
| 10,441,772 | B2 | 10/2019 | Lucas | |
| 10,837,128 | B2 | 11/2020 | Griesshammer et al. | |
| 10,953,964 | B2 | 3/2021 | O'Rourke | |
| 2014/0262616 | A1 * | 9/2014 | Cullum | E06C 7/188 242/384.7 |
| 2019/0367321 | A1 * | 12/2019 | Lucas | A61M 16/0672 |
| 2020/0046978 | A1 * | 2/2020 | Kaufmann | A61N 1/372 |
| 2022/0112048 | A1 * | 4/2022 | Dellach | B65H 75/4423 |

FOREIGN PATENT DOCUMENTS

| | | | |
|---|---|---|---|
| CN | 202728553 | U | 2/2013 |
| CN | 202754125 | U | 2/2013 |
| CN | 203698631 | U | 7/2014 |
| CN | 210882558 | U | 6/2020 |
| DE | 20312098 | U1 | 10/2003 |
| GB | 1121658 | A | 7/1958 |
| JP | 59069357 | A | 4/1984 |
| JP | 3065911 | B2 | 7/2000 |
| WO | WO201184069 | A1 | 7/2011 |

* cited by examiner

*Primary Examiner* — Thomas M Wittenschlaeger
*Assistant Examiner* — Katie L Gerth
(74) *Attorney, Agent, or Firm* — Dennis D. Brown; Brown Patent Law, P.L.L.C.

(57) ABSTRACT

A stuffing device and method for stuffing a rope or other cord into a water rescue throw bag, a life safety bag, or other bag wherein the stuffing device can be held in or above the mouth of the bag by hand or using a stand, the device can be produced in small or large sizes for use with bags and cords of different size, and the device can be operated by hand or by using a power tool.

11 Claims, 5 Drawing Sheets

DEVICE AND METHOD FOR STUFFING THROW BAGS AND LIFE SAFETY BAGS

FIELD OF THE INVENTION

The present invention relates to devices and methods for stuffing ropes or other cords into water rescue throw bags, life safety bags, or other bags.

BACKGROUND OF THE INVENTION

A throw bag is a water rescue device comprising a length of rope or other cord which is stuffed into the bag in a manner which allows the cord to freely pay out of the top of the bag as the user holds the end of the cord and tosses the bag toward a person or other target in the water. Although other sizes are also used, the cord will typically be a ⅜-inch cord ranging in length from 50 feet or less up to 75 feet or 100 feet or more. The cord will preferably be formed of a buoyant material, e.g., polypropylene rope, and a foam disc will typically be positioned on the distal end of the cord inside the bag to keep the empty bag afloat.

Life safety ropes are used for supporting people during rescue, fire-fighting, and other emergency operations. Life safety ropes are often stored in bags for transport and storage purposes, and for quick deployment in emergency and rope access situations. Although other sizes can also be used, a life safety rope will typically be a 7⁄16-inch or M-inch rope or other cord ranging in length from 150 feet or less up to 600 feet or more.

In the case of both throw bags and life safety bags, the rope or other cord will preferably be loosely stuffed into the bag in order to allow the cord to pay out freely for purposes of trouble-free throwing or other emergency use. Although other techniques such as coiling the cord and pushing the coil into the bag might be quicker, such techniques can cause tangling and snagging problems which are not acceptable for emergency use.

Unfortunately, for a rope or other cord to be properly stuffed into a throw bag or life safety bag, it has been necessary heretofore to stuff the cord into the bag by hand. However, this process is slow and inconvenient. In addition, stuffing the bag by hand can be inconsistent due, e.g., to inexperience or carelessness, and can also produce tangling or snagging problems if not properly done.

Consequently, a need exists for a device and method for stuffing ropes or other cords into water rescue throw bags, life safety bags, and other bags wherein (a) the device and method are quicker, easier, and more convenient than hand stuffing, (b) the device and method will more consistently stuff the cord into the bag in a proper manner, and (c) the device and method will help to eliminate the tangling and snagging problems caused by inexperience or carelessness when using hand-stuffing techniques.

SUMMARY OF THE INVENTION

The present invention provides a stuffing device, a stuffing apparatus, and a stuffing method which satisfy the needs and alleviate the problems mentioned above. The inventive stuffing device, apparatus, and method (1) are quick and easy to use, (2) will consistently ensure that the rope or other cord is stuffed into the bag in a proper manner, and (3) can prevent tangling and snagging problems even when used by inexperienced personnel.

In one aspect, there is provided a stuffing device for stuffing a rope or other cord into a throw bag, a life safety bag, or other bag. The device preferably comprises: (a) a housing having a top, a bottom, and an outer perimeter and (b) an open slot which extends laterally from the outer perimeter into the housing, the open slot having (i) an open inlet end at the outer perimeter of the housing for delivering the rope or other cord into, and removing the rope or other cord from, the open slot, (ii) an open top, at the top of the housing, which extends along the length of the open slot, and (iii) an open bottom, at the bottom of the housing, which extends along the length of the open slot.

The stuffing device preferably further comprises: (c) a drive wheel which is rotatably mounted in the housing, the drive wheel having a contacting surface which surrounds the drive wheel and extends toward or into the open slot; (d) an idler wheel which is rotatably mounted in the housing, the idler wheel having a contacting surface which surrounds the idler wheel and extends toward or into the open slot opposite the contacting surface of the drive wheel to form a gap between the contacting surface of the drive wheel and the contacting surface of the idler wheel which receives the rope or other cord delivered into the open slot; (e) one or more biasing elements in the housing which urge the idler wheel toward the drive wheel; and (f) a turning member which extends into the housing to the drive wheel for rotating the drive wheel.

In another aspect, there is provided an apparatus for stuffing a rope or other cord into a life safety, throw, or other bag. The apparatus preferably comprises (a) a stand for hanging the bag and (b) a stuffing device, preferably of the type described above, which is held by the stand above or inside an upper opening of the bag.

In another aspect, the stuffing device can be a hand-held device which is held in the opening of the bag by hand.

In another aspect, there is provided a method of stuffing a rope or other cord into a throw bag, a life safety bag, or other bag. The method preferably comprises the step of (a) positioning a stuffing device in or above an opening of the bag, wherein the stuffing device preferably comprises: (i) a housing having a top, a bottom, and an outer perimeter, (ii) an open slot which extends laterally from the outer perimeter into the housing, the open slot having an open inlet end at the outer perimeter of the housing, (iii) a drive wheel which is rotatably mounted in the housing, the drive wheel having a contacting surface which surrounds the drive wheel and extends toward or into the open slot, (iv) an idler wheel which is rotatably mounted in the housing, the idler wheel having a contacting surface which surrounds the idler wheel and extends toward or into the open slot opposite the contacting surface of the drive wheel to form a gap between the contacting surface of the drive wheel and the contacting surface of the idler wheel, (v) one or more biasing elements in the housing which urge the idler wheel toward the drive wheel, and (vi) a turning member which extends into the housing to the drive wheel.

The method preferably also comprises: a step (b), performed before, during, or after step (a), of delivering the rope or other cord into the open slot of the stuffing device and positioning the rope or other cord in the gap between the contacting surface of the drive wheel and the contacting surface of the idler wheel; and a step (c), performed after steps (a) and (b), of turning the turning member to rotate the drive wheel to pull the rope or other cord through the stuffing device and deliver the rope or other cord into the bag.

Further objects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
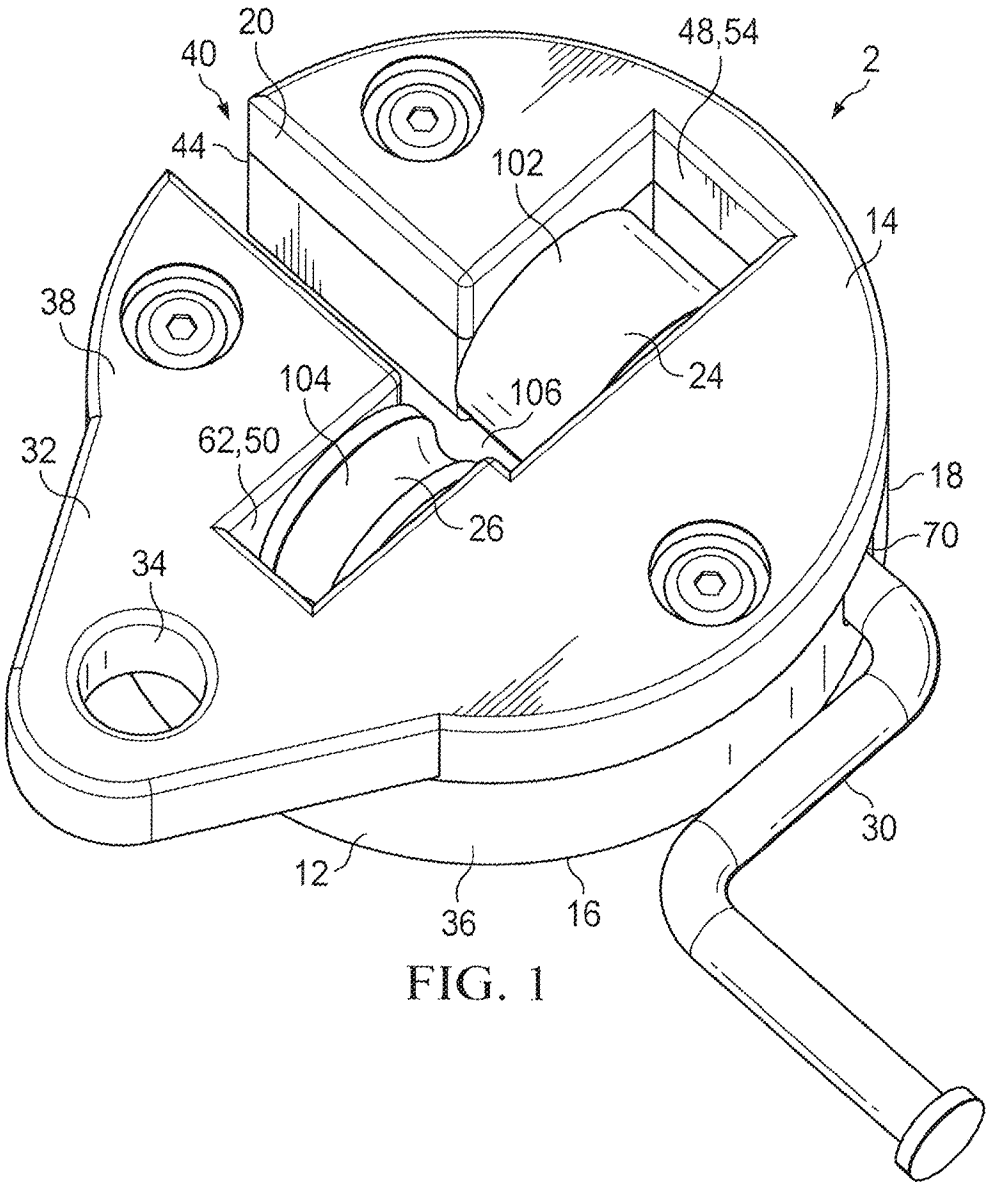
FIG. 1 is a perspective view of an embodiment 2 of the stuffing device provided by the present invention.
Figure 2:
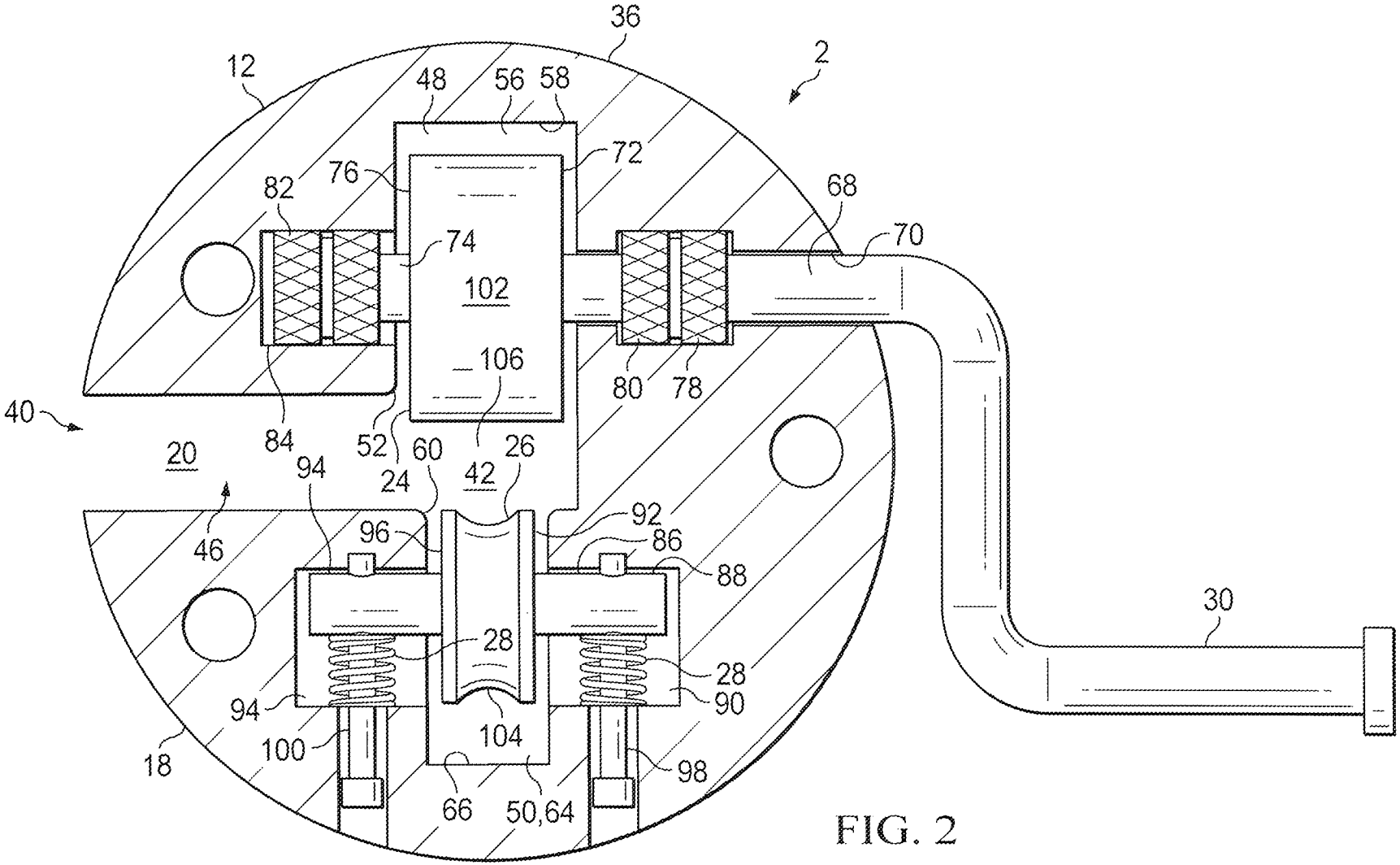
FIG. 2 is a cutaway top view of the inventive stuffing device 2.
Figure 3:
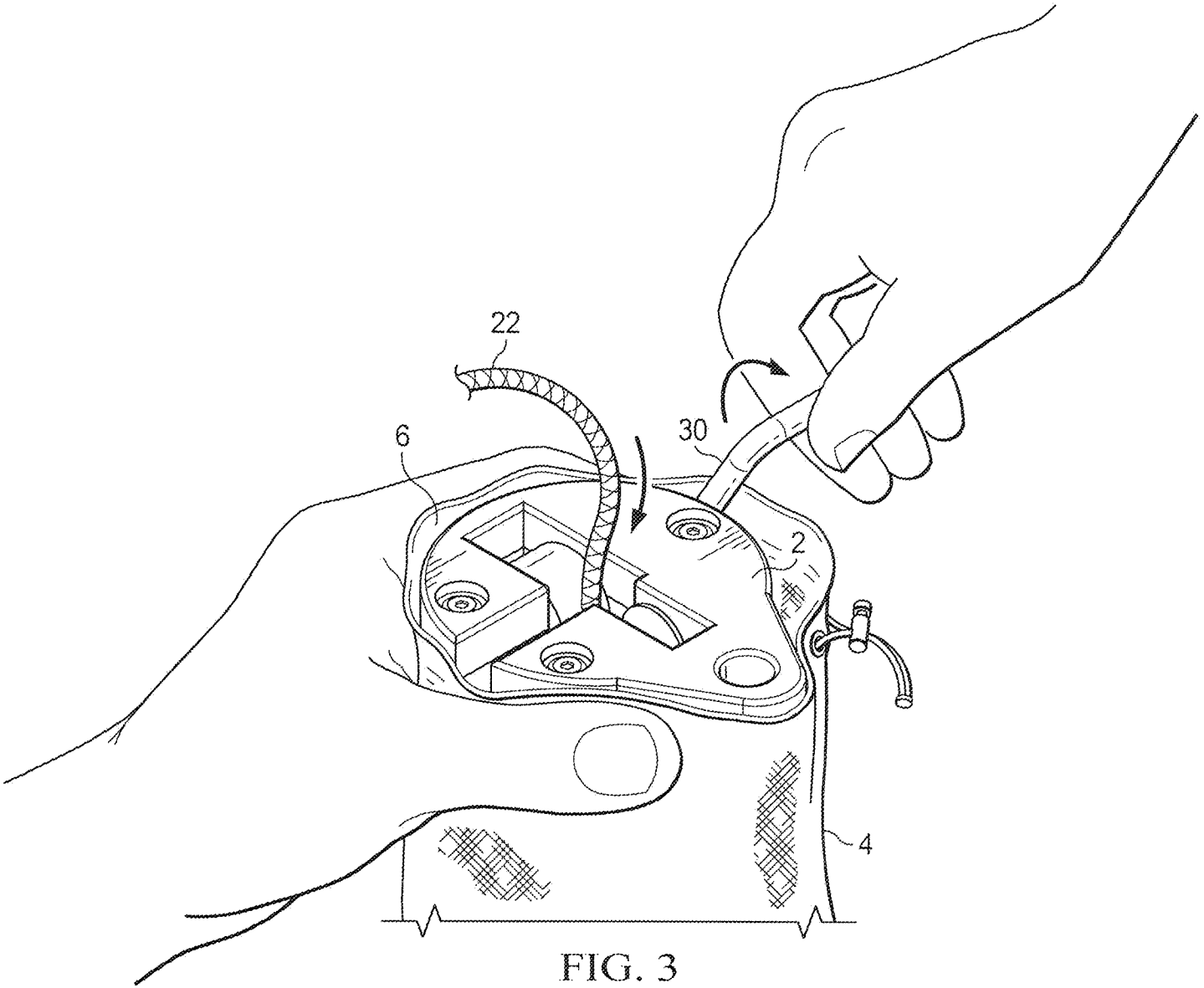
FIG. 3 illustrates the inventive stuffing device 2 being held by hand in the top opening 6 of a bag 4 and being used to stuff a cord 22 into the bag 4.

An embodiment 2 of the inventive stuffing device is illustrated in FIGS. 1-3. The inventive stuffing device 2 is well suited for production as a hand-sized device for holding in the open top 6 of a throw bag or other bag 4 as shown in FIG. 3, but can alternatively be produced in larger sizes, e.g., for use in a stand 8 of the type shown in FIG. 5 for hanging and stuffing a larger bag 10.

The stuffing device 2 preferably comprises: a housing 12 having a top 14, a bottom 16, and a surrounding outer perimeter 18; an open side slot 20 which extends laterally from the outer perimeter 18 into the housing 12 for receiving the rope or other cord 22 of the bag 4 or 10; a drive wheel 24 which is rotatably mounted in the housing 12; an idler wheel 26 which is rotatably mounted in the housing 12; one or more biasing elements 28 in the housing 12 which continuously urge the idler wheel 26 toward the drive wheel 24; a turning member 30 which extends into the housing 12 to the drive wheel 24; and an ear 32 which projects from the housing 12.

The ear 32 has an aperture 34 therethrough for receiving an attachment rope, an attachment cord, a carabiner or other clip, or other attachment device for carrying the stuffing device 2, e.g., by attaching the stuffing device 2 to a life vest, to a backpack, to the user's clothing, or to other gear worn or carried by the user.

The housing 12 comprises a lower housing body 36 and a housing cover 38 which is bolted, glued, and/or otherwise secured on top of the body 36. Although other shapes can be used, the outer perimeter 18 of the housing body 36 is preferably circular to facilitate holding the stuffing device 2 in one hand. At least most of the outer perimeter of the housing cover 38 also has a corresponding circular shape, except for the attachment ear 32 which preferably projects from the perimeter of the housing cover 38. It will be understood, however, that the attachment ear 32 can alternatively project from the perimeter 18 of the housing body 36 or from both the housing cover 38 and the housing body 36.

The open side slot 20 of the housing 12 extends laterally from an outer perimeter opening 40 of the open slot 20 to an inner end portion 42 of the open slot 20. The inner end portion 42 of the open side slot 20 is preferably located in the central portion or area of the housing 12. The open side slot 20 also has (i) an open top 44 at the top 14 of the housing 12 (i.e., through the housing cover 38) and (ii) an open bottom 46 at the bottom of the housing 12 (i.e., through the bottom of the lower housing body 36). The open top 44 and the open bottom 46 extend along the length of the open side slot 20.

The housing 12 also includes (a) an open drive wheel slot 48 in which the drive wheel 24 is rotatably positioned and (b) an open idler wheel slot 50, opposite the drive wheel slot 48, in which the idler wheel 26 is rotatably positioned. The drive wheel 24 and the idler wheel 26 are preferably perpendicular to the open slot 20. The open drive wheel slot 48 extends from, and is preferably perpendicular to, the open side slot 20 and includes: an open inner end 52 which is in communication with the inner end portion 42 of the open side slot 20: an open top 54; an open bottom 56; and a closed outer end 58. The open idler wheel slot 50 also extends from and is preferably perpendicular to the open side slot 20 and includes: an open inner end 60, opposite the open inner end 52 of the drive wheel slot 48, which is in communication with the inner end portion 42 of the open side slot 20; an open top 62; an open bottom 64; and a closed outer end 66.

The drive wheel 24 is secured or formed in fixed position on the turning member 30 so that the drive wheel 24 must rotate with the turning member 30. The turning member 30 includes (a) a first segment 68 which extends through a perimeter opening 70 of the housing 12 to a first side 72 of the drive wheel 24 and (b) a distal segment 74 which extends from the opposite side 76 of the drive wheel 24. The first segment 68 of the turning member 30 rotatably extends through one or more bushings and/or bearings 78 which are held in a cavity 80 forned in the lower housing body 36 adjacent the drive wheel slot 48 on the first side 72 of the drive wheel 24. The distal segment 74 of the turning member 30 rotatably extends through one or more bushings and/or bearings 82 held in a cavity 84 formed in the lower housing body 36 adjacent the drive wheel slot 48 on the opposite side 76 of the drive wheel 24.

In the embodiment 2 of the inventive stuffing device shown in FIGS. 1-3, the turning member 30 of the device 2 is a hand crank for rotating the drive wheel 24 by hand.

The idler wheel 26 is rotatably held on an idler shaft 86 which extends through the idler wheel 26. A first end segment 88 of the idler shaft 86 extends into a cavity 90 formed in the lower housing body 36 adjacent the idler wheel slot 50 on a first side 92 of the idler wheel 26. An opposite end segment 94 of the idler shaft 86 extends into a cavity 94 formed in the lower housing body 36 adjacent the idler wheel slot 50 on the opposite side 96 of the idler wheel 26.

The idler shaft 86 is retained in the lower housing body 36 by a pair of pins 98 and 100 which extend, respectively, into the idler shaft cavities 90 and 94 of the lower body 36 and through the end segments 88 and 94 of the idler shaft 86. The pins 98 and 100 prevent the idler shaft 86 from rotating and are perpendicular to the idler shaft 86 so that the idler shaft 86 can slide on the pins 98 and 100 and carry the idler wheel 26 toward and away from the drive wheel 24. The one or more biasing elements 28 used in the inventive stuffing device 2 continuously urge the idler shaft 86 and the idler wheel 26 toward the drive wheel 24.

In the embodiment 2 of the inventive device shown in FIG. 2, the biasing elements 28 are coil springs which are positioned in the idler shaft cavities 90 and 94 around the pins 98 and 100. However, it will be understood that other common types of springs, or other biasing elements, can alternatively be used.

The drive wheel 24 has a contacting surface 102 which surrounds the drive wheel 24 and extends toward or into the inner end portion 42 of the open side slot 20 of the housing 12. The idler wheel 26 has a contacting surface 104 which surrounds the idler wheel 26 and extends toward or into the inner portion 42 of the open side slot 20, opposite the contacting surface 102 of the drive wheel 24, such that a gap 106 for receiving the rope or other cord 22 of the bag 4 or 10 is formed in the inner end portion 42 of the open side slot 20 between the contacting surface 102 of the drive wheel 24 and the contacting surface 104 of the idler wheel 26. The biasing elements 28 acting on the idler wheel 26 operate to continuously press the rope or other cord 22, regardless of size, into gripping contact with drive wheel 24 while also allowing the gap 106 between the drive wheel 24 and the idler wheel 26 to expand as needed to receive a cord 22 of larger diameter.

The contacting surface 102 of the drive wheel 24 can be formed of any material which is effective for gripping the rope or other cord 22 and pulling the cord 22 through the inventive stuffing device 2. Examples of such materials include, but are not limited to, polyurethane rubber and polyurethane silicone. To further assist in gripping, and to operate as a guide for retaining the cord 22 in place between the drive wheel 24 and the idler wheel 26, the contacting surface 104 of the idler wheel 26 is preferably concave (inwardly curved).

Figure 4:
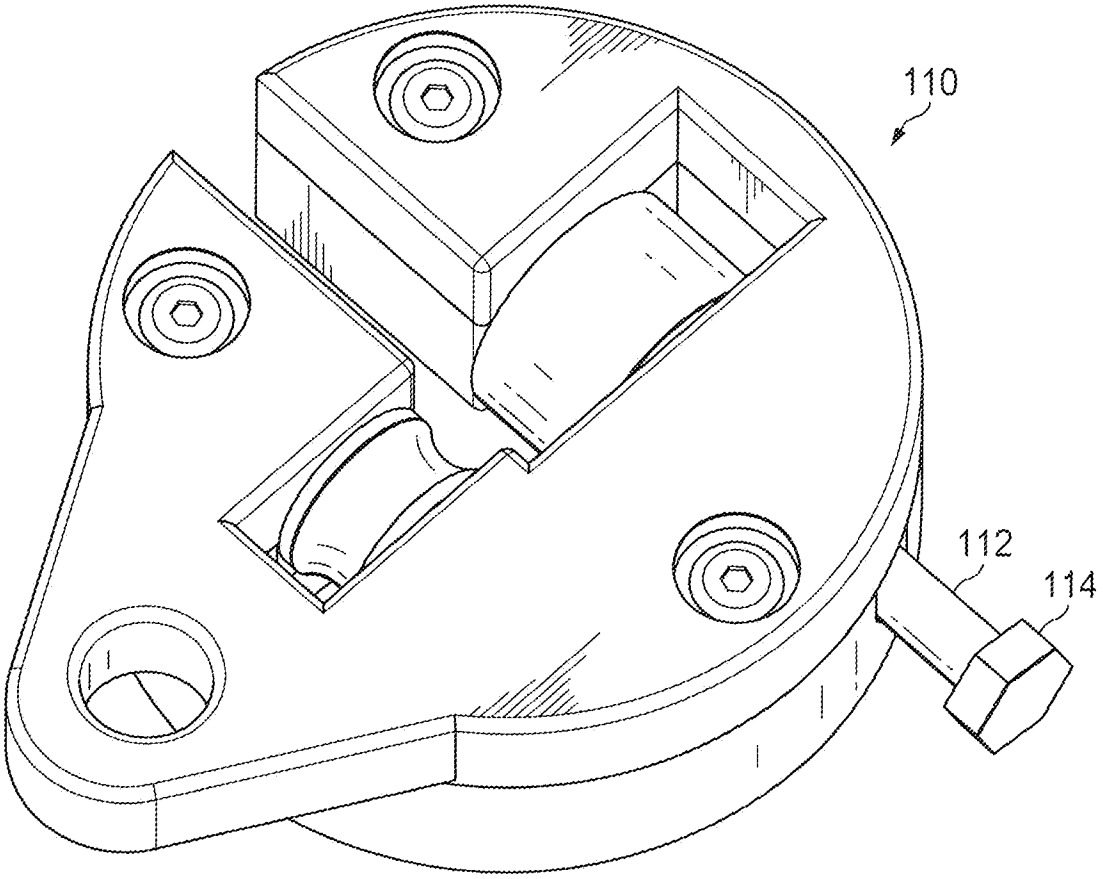
FIG. 4 is a perspective view of an alternative embodiment 110 of the inventive stuffing device.
Figure 5:
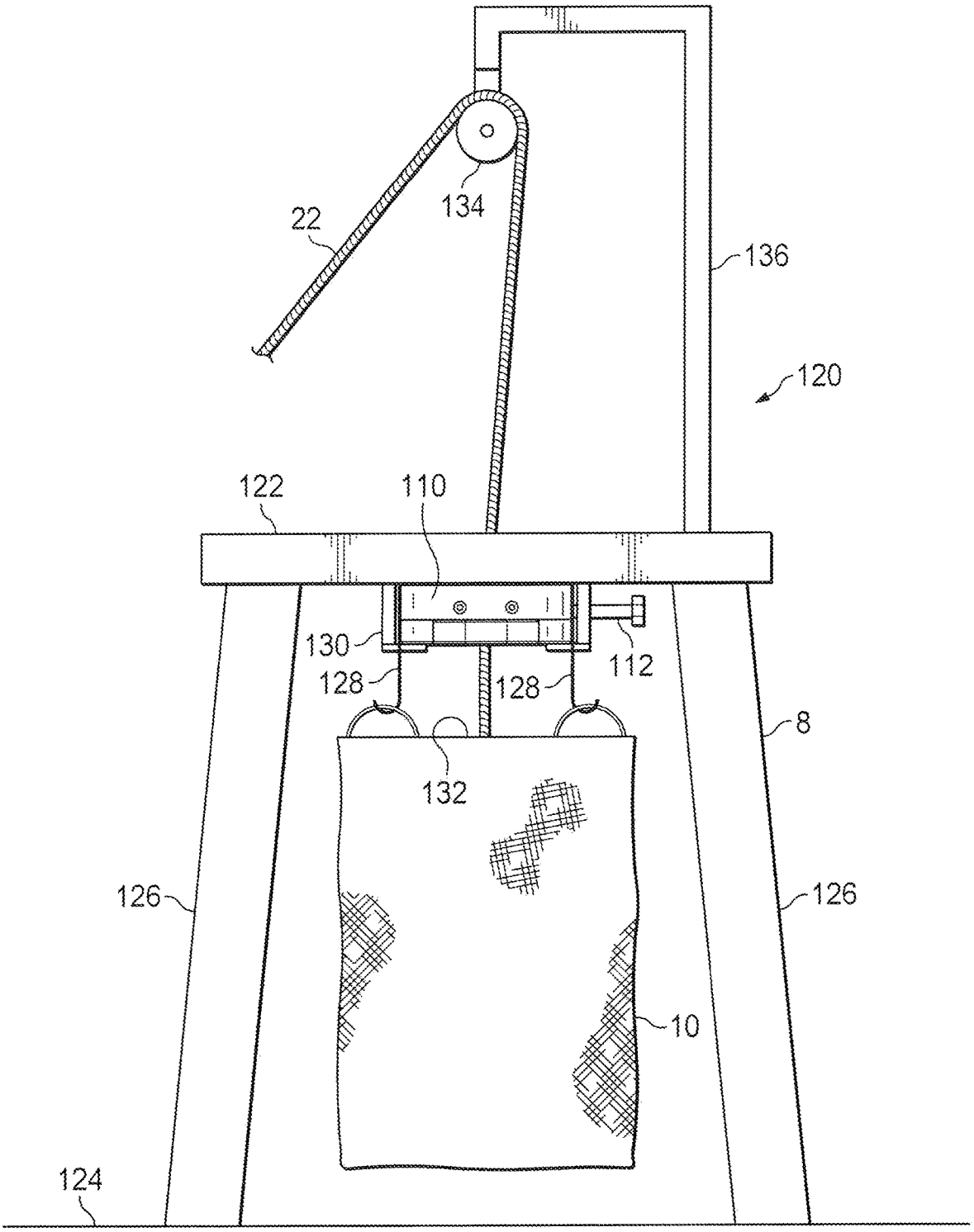
FIG. 5 illustrates an inventive apparatus 120 comprising (i) a stand 8 for hanging a bag 10 and (ii) an inventive stuffing device 110 which is held by the stand 8 above or inside the open top 132 of the bag 10.

An alternative embodiment 110 of the inventive stuffing device is depicted in FIGS. 4 and 5. The alternative embodiment 110 is the same as the embodiment 2 shown in FIGS. 1-3 except that the turning member 112 of the inventive device 110 is a drive shaft which is preferably rotated by a power tool. By way of example, the drive shaft 112 is shown as having a hex head 114 on the projecting outer end thereof for turning the drive shaft 112 using an impact driver, a power drill, a pneumatic wrench, or other power tool.

The inventive stuffing device 110 is well suited for production in larger sizes, e.g., for use in a stand 8 of the type shown in FIG. 5 for hanging and stuffing a larger life safety bag or other large bag 10. However, the inventive stuffing device 110 can also be produced as a smaller hand-held device for, e.g., holding the device 110 in the open top 6 of a smaller throw bag 4.

The apparatus 120 illustrated in FIG. 5 which uses the stand 8 for stuffing a larger bag 10 comprises: a horizontal frame or platform 122 of the stand 8 which is supported above the ground or floor 124 by a plurality of upwardly extending legs 126: a plurality of bag hooks or other bag attachments 128 which extended downwardly from or are provided on the bottom of the horizontal frame or platform 122; a holder 130 on the bottom, on the top, or in the horizontal frame or platform 122 which holds the inventive stuffing device 110 or 2 above or inside the open top 132 of the bag 10; a pulley or other guide 134 for the rope or other cord 22; and an arm 136 which extends upwardly from the horizontal frame or platform 122 to support and position the guide 134 above the inventive stuffing device 110 or 2.

In the method of the present invention for stuffing a rope or other cord 22 into a throw bag 4, a life safety bag 10, or other bag, the inventive stuffing device 2 or 110 is positioned in or above the top opening 6 or 132 of the bag 4 or 10. Before, during, or after this step, the cord 22 of the bag 4 or 10 is delivered into the open side slot 20 of the stuffing device 2 or 110 and is positioned in the gap 106 between the contacting surface 102 of the drive wheel 24 and the contacting surface 104 of the idler wheel 26. Subsequently, the crank handle 30, drive shaft 112, or other turning member of the stuffing device 2 or 110 is turned to rotate the drive wheel 24 to pull the cord 22 through the stuffing device 2 or 110 and thereby deliver the rope or other cord 22 into the bag 4 or 10.

If the stuffing device 2 or 110 is a hand-held device, the stuffing device 2 or 110 will preferably be held in the top opening 6 or 132 of the bag 4 or 10 by hand. The hand-held device will preferably be a device 2 as illustrated in FIGS. 1-3 and the turning member of the device 2 will preferably be a crank handle 30 which is turned by hand.

If a stand 8 is used to stuff the bag 10 as illustrated in FIG. 5, the step of the inventive method of positioning the stuffing device 2 or 110 in the top opening 132 of the bag 10 will preferably also include hanging the bag 10 from the horizontal frame or platform 122 of the stand 8. In addition, the stuffing device used in the stand 8 will preferably be the device 110 illustrated in FIGS. 4 and 5 and the turning member of the device 110 will preferably be a drive shaft 112 which is turned using a power tool.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A device for stuffing a rope or other cord into a throw bag, a life safety bag, or other bag comprising:

a housing having an outer perimeter;

an open slot for the rope or other cord which is formed in a face of the housing and extends laterally through the outer perimeter of the housing;

a drive wheel which is rotatably mounted in the housing, the drive wheel having a contacting surface which surrounds the drive wheel and extends toward or into the open slot;

an idler wheel which is rotatably mounted in the housing, the idler wheel having a contacting surface which surrounds the idler wheel and extends toward or into the open slot opposite the contacting surface of the drive wheel to form a gap between the contacting surface of the drive wheel and the contacting surface of the idler wheel; and a turning member which extends into the housing to the drive wheel for rotating the drive wheel, wherein the open slot is configured to receive any intermediate portion of the rope or other cord in the open slot and deliver the intermediate portion of the rope or other cord into the gap between the contacting surface of the drive wheel and the contacting surface of the idler wheel without threading either of a first end or a second end of the rope or other cord into the slot or through the gap between the contacting surface of the drive wheel and the contacting surface of the idler wheel.

2. The device of claim 1, further comprising the drive wheel and the idler wheel being perpendicular to the open slot.

3. The device of claim 1, further comprising the open slot extending into a central portion of the housing and the gap between the contacting surface of the drive wheel and the contacting surface of the idler wheel being located in the central portion of the housing.

4. The device of claim 1, further comprising the contacting surface of the idler wheel being a concave surface.

5. The device of claim 1, further comprising the idler wheel being rotatably positioned on an idler shaft which is perpendicular to the idler wheel and the one or more biasing elements contacting the idler shaft to continuously urge the idler wheel toward the drive wheel.

6. The device of claim 1, further comprising the turning member rotatably extending through one or more bushings and/or bearings located in the housing.

7. The device of claim 1, further comprising an ear which projects from the housing and has an aperture therethrough for receiving an attachment rope, an attachment cord, a carabiner or other clip, or other attachment for carrying the device.

8. The device of claim 1, further comprising the device being a hand-held device.

9. The device of claim 1, further comprising at least most of the outer perimeter of the housing having a circular shape for gripping in one hand.

10. The device of claim 1, further comprising the turning member being a hand crank.

11. The device of claim 1, further comprising the turning member comprising a drive shaft rotated by a power tool.

* * * * *